US011199788B1

(12) United States Patent
Ueda

(10) Patent No.: US 11,199,788 B1
(45) Date of Patent: Dec. 14, 2021

(54) EXPOSURE HEAD AND IMAGE FORMING APPARATUS

(71) Applicant: TOSHIBA TEC KABUSHIKI KAISHA, Tokyo (JP)

(72) Inventor: Motoshi Ueda, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/024,972

(22) Filed: Sep. 18, 2020

(51) Int. Cl.
*G03G 15/04* (2006.01)
*G03G 15/00* (2006.01)
*H05B 45/00* (2020.01)

(52) U.S. Cl.
CPC ..... *G03G 15/04054* (2013.01); *G03G 15/80* (2013.01); *H05B 45/60* (2020.01); *G03G 2215/0409* (2013.01)

(58) Field of Classification Search
CPC ..... G03G 2215/0409; G03G 15/04054
See application file for complete search history.

(56) References Cited

U.S. PATENT DOCUMENTS

2005/0068355 A1 3/2005 Nomura et al.
2007/0188583 A1 8/2007 Nomura et al.
2008/0252713 A1* 10/2008 Horikawa ..... G03G 15/326 347/237
2016/0131989 A1 5/2016 Yano et al.
2018/0314184 A1* 11/2018 Watanabe ..... G03G 15/043
2020/0103783 A1 4/2020 Tanimoto

FOREIGN PATENT DOCUMENTS

JP 2015-101059 6/2015

* cited by examiner

*Primary Examiner* — Victor Verbitsky
(74) *Attorney, Agent, or Firm* — Amin, Turocy & Watson, LLP

(57) ABSTRACT

An exposure head includes a light emitter, a plurality of switches, a transmission line, and a plurality of delay circuits. In the light emitter, a plurality of light emitting elements are arranged in a first direction. The switches are provided respectively corresponding to the light emitting elements. The switches are configured to perform switching such that, when a drive signal is input, a drive current flows through a light emitting element corresponding to the drive signal. The transmission line is configured to supply a drive signal to the switches. The delay circuits are provided respectively corresponding to the switches. The delay circuits are configured to delay the drive signal that is supplied to the switches through the transmission line in order from a first end side to a second end side of the light emitting elements arranged in the first direction.

14 Claims, 9 Drawing Sheets

EXPOSURE HEAD AND IMAGE FORMING APPARATUS

FIELD

Embodiments described herein relate generally to an exposure head and an image forming apparatus.

BACKGROUND

An exposure head is a print head for selectively exposing an outer circumferential surface of a photosensitive drum that is uniformly charged to form an image. The exposure head is used for an image forming apparatus using an electrophotographic process. The image forming apparatus is, for example, a printer, a copying machine, or a multi-function peripheral (MFP).

The exposure head includes alight emitting unit in which a plurality of light emitting elements are arranged in a first direction. The light emitting element is, for example, alight emitting diode (LED). The light emitting element may be, for example, an organic light emitting diode (OLED), that is, an organic EL.

In the vicinity of the photosensitive drum, the exposure head is attached such that the light emitting element array in the light emitting unit are arranged in a longitudinal direction of the photosensitive drum. The longitudinal direction of the photosensitive drum is a main scanning direction for forming an image. The photosensitive drum rotates in a sub-scanning direction. Therefore, when the exposure head is attached parallel to the main scanning direction, an image is formed on the photosensitive drum without being inclined with respect to the main scanning direction. However, the exposure head is not necessarily limited to being attached parallel to the main scanning direction. Due to the effect of the accuracy of a head attachment portion, the exposure head may be attached at an angle inclined with respect to the main scanning direction.

Here, in an image forming apparatus of the related art, information regarding the inclination with respect to the main scanning direction are stored in a memory as correction data, and image data are corrected using the correction data such that the inclination of the exposure head is canceled out. As a result, the image forming apparatus can form an image parallel to the main scanning direction. However, the image forming apparatus requires calculation for correction. Therefore, the processing load of a processor is high. Significant memory resources are required.

DETAILED DESCRIPTION

In general, according to one embodiment, an exposure head includes a light emitting unit, a plurality of switching elements, a transmission line, and a plurality of delay circuits. In the light emitting unit, a plurality of light emitting elements are arranged in a first direction. The switching elements are provided respectively corresponding to the light emitting elements. The switching elements are configured to perform switching such that, when a drive signal is input, a drive current flows through a light emitting element corresponding to the drive signal. The transmission line is configured to supply a drive signal to the switching elements. The delay circuits are provided respectively corresponding to the switching elements. The delay circuits are configured to delay the drive signal that is supplied to the switching elements through the transmission line in order from a first end side to a second end side of the light emitting elements arranged in the first direction.

Hereinafter, some embodiments will be described with reference to the drawings.

First, the summary of an exposure head and an image forming apparatus including the exposure head will be described using FIGS. 1 to 5.

Figure 1:
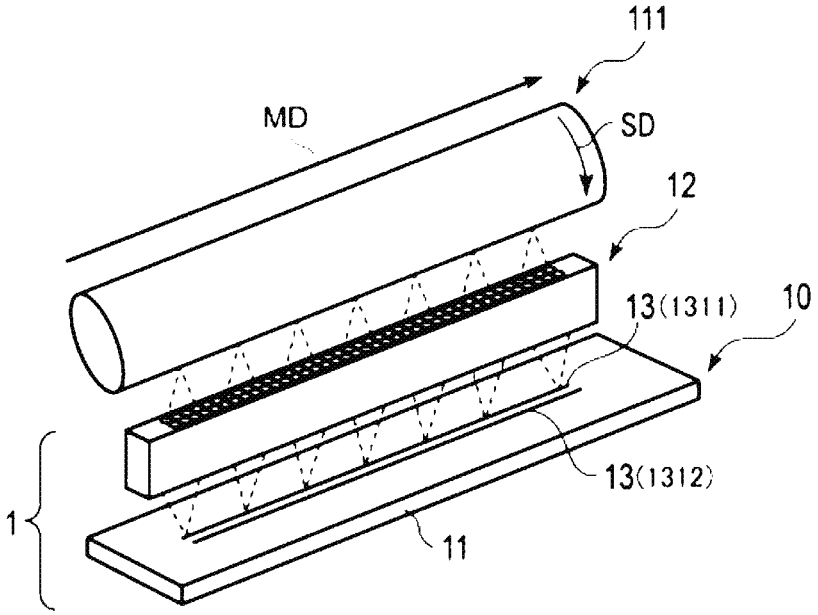
FIG. 1 is a diagram illustrating a position relationship between a photosensitive drum and an exposure head that is applied to an image forming apparatus according to an embodiment.

FIG. 1 is a diagram illustrating a position relationship between a photosensitive drum 111 and an exposure head 1 that are applied to an image forming apparatus according to an embodiment. For example, the image forming apparatus such as a printer, a copying machine, or a multi-function peripheral includes the photosensitive drum 111 that is a cylindrical photoreceptor. The exposure head 1 is attached to face the photosensitive drum 111 through a head attachment portion (not illustrated).

The photosensitive drum 111 rotates in a direction of arrow SD illustrated in FIG. 1. Hereinafter, the rotation direction will be referred to as "sub-scanning direction SD". A longitudinal direction of the photosensitive drum 111, that is, a direction perpendicular to the sub-scanning direction SD will be referred to as "main scanning direction MD".

The photosensitive drum 111 is uniformly charged by a charging unit. When an outer circumferential surface of the uniformly charged photosensitive drum 111 is selectively exposed to light emitted from the exposure head 1, the potential of the exposed portion decreases. That is, in the image forming apparatus, by controlling the emission and the non-emission of the exposure head 1, an electrostatic latent image can be formed on the photosensitive drum 111.

The exposure head 1 includes a light emitting unit 10 and a rod lens array 12. The light emitting unit 10 includes a transparent substrate 11. The transparent substrate 11 is, for example, a glass substrate that allows transmission of light. Alight emitting element array 13 including a plurality of light emitting elements is formed on the transparent substrate 11.

In the exposure head 1 illustrated in FIG. 1, for example, two arrays including a first light emitting element array 1311 and a second light emitting element array 1312 are formed parallel to each other. In the embodiment, a case where the exposure head 1 includes a plurality of light emitting element arrays 13 will be described. The exposure head 1 may include a single light emitting element array 13.

Figure 2:
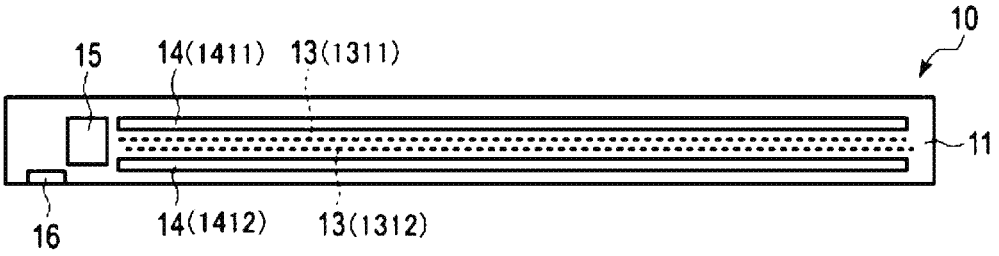
FIG. 2 is a diagram illustrating an example of a transparent substrate that configures the exposure head.

FIG. 2 is a diagram illustrating an example of the transparent substrate 11 that configures the exposure head 1. As illustrated in FIG. 2, the two light emitting element arrays 13 including the first light emitting element array 1311 and the second light emitting element array 1312 are formed at the center portion on the transparent substrate 11 in a longitudinal direction of the transparent substrate 11. In the vicinity of the light emitting element array 13, a drive circuit array 14 is formed to drive the respective light emitting elements to emit light. That is, a first drive circuit array 1411 corresponding to the first light emitting element array 1311 and a second drive circuit array 1412 corresponding to the second light emitting element array 1312 are formed on the transparent substrate 11. FIG. 2 illustrates an example in which the drive circuit array 14 is arranged on both sides of the two light emitting element arrays 13. The two drive circuit arrays 14 may be arranged on a single side of the two light emitting element arrays 13.

An integrated circuit (IC) chip 15 is arranged at an end portion of the transparent substrate 11. The transparent substrate 11 includes a connector 16. The connector 16 electrically connects the exposure head 1 and a control system of a printer, a copying machine, or a multi-function peripheral to each other. The connection enables power supply, head control, image data transfer, and the like.

A substrate for sealing the light emitting element array 13, the drive circuit array 14, and the like to prevent contact with outside air is attached to the transparent substrate 11. When it is difficult to mount the connector on the transparent substrate 11, a flexible printed circuit (FPC) may be connected to the transparent substrate 11 for electrical connection to the control system.

Figure 3:
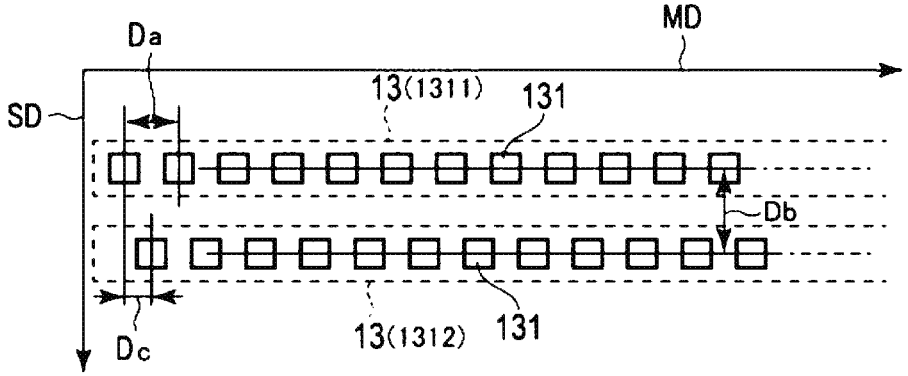
FIG. 3 is a diagram illustrating an example of a light emitting element array that is arranged on the transparent substrate of the exposure head.

FIG. 3 is a diagram illustrating an example of the light emitting element array 13. As illustrated in FIG. 3, in the first light emitting element array 1311 and the second light emitting element array 1312, a plurality of light emitting elements 131 are arranged in the main scanning direction MD perpendicular to a moving direction of the photosensitive drum 111, that is, the sub-scanning direction SD. That is, the first light emitting element array 1311 on the upstream side and the second light emitting element array 1312 on the downstream side in the sub-scanning direction SD are parallel to the main scanning direction MD in principle.

The light emitting element 131 has, for example, a 20 μm square shape. An arrangement interval Da of the light emitting elements 131 in the light emitting element array 13 is regular. For example, the arrangement interval Da is a pitch of about 42.3 μm corresponding to a resolution of 600 dpi. That is, the light emitting elements 131 forming the first light emitting element array 1311 and the light emitting elements 131 forming the second light emitting element array 1312 are arranged shifted in the main scanning direction MD at the regular arrangement interval Da only.

The first light emitting element array 1311 on the upstream side and the second light emitting element array 1312 on the downstream side in the sub-scanning direction SD are arranged in the sub-scanning direction SD at an interval of a distance Db. The respective light emitting elements 131 forming the first light emitting element array 1311 and the respective light emitting elements 131 forming the second light emitting element array 1312 are arranged shifted in the main scanning direction MD at a predetermined pitch Dc only. For example, the predetermined pitch Dc is half of the arrangement interval Da. Due to the above-described arrangement, the light emitting elements 131 arranged in the first light emitting element array 1311 and the light emitting elements 131 arranged in the second light emitting element array 1312 are arranged in a zigzag shape.

When the respective light emitting elements 131 forming the first light emitting element array 1311 on the upstream side and the respective light emitting elements 131 forming the second light emitting element array 1312 on the downstream side in the sub-scanning direction SD emit light at the same timing, an exposure pattern having a zigzag shape is formed on the photosensitive drum 111. Therefore, a control unit described below causes the respective light emitting elements 131 forming the first light emitting element array 1311 and the respective light emitting elements 131 forming the second light emitting element array 1312 to emit light at the different timings such that an exposure pattern corresponding to one line is formed on the photosensitive drum 111. Specifically, the control unit delays the emission timing of the second light emitting element array 1312 by a given period of time with respect to that of the first light emitting element array 1311 depending on the moving speed of the photosensitive drum 111 and the distance Db. In other words, at different timings depending on the moving speed of the photosensitive drum 111 and the distance Db, the control unit 174 outputs first image data to the first light emitting element array 1311 and outputs second image data to the second light emitting element array 1312. Here, the first image data and the second image data correspond to image data corresponding to one line in the main scanning direction. Due to such control, an electrostatic latent image is formed on the photosensitive drum at a resolution of 1200 dpi.

Therefore, the control unit can increase the density of the image by controlling the emission timings of the light emitting element arrays 13, that is, transfer timings of the image data. In the case of two light emitting element arrays 13, the density of the image can be increased to be twice the density of the light emitting elements 131 of one array. In the case of an n ($n \geq 3$, n: an integer) number of light emitting element arrays 13, the density of the image can be increased to be n times the density of the light emitting elements 131 of one array.

Figure 4:
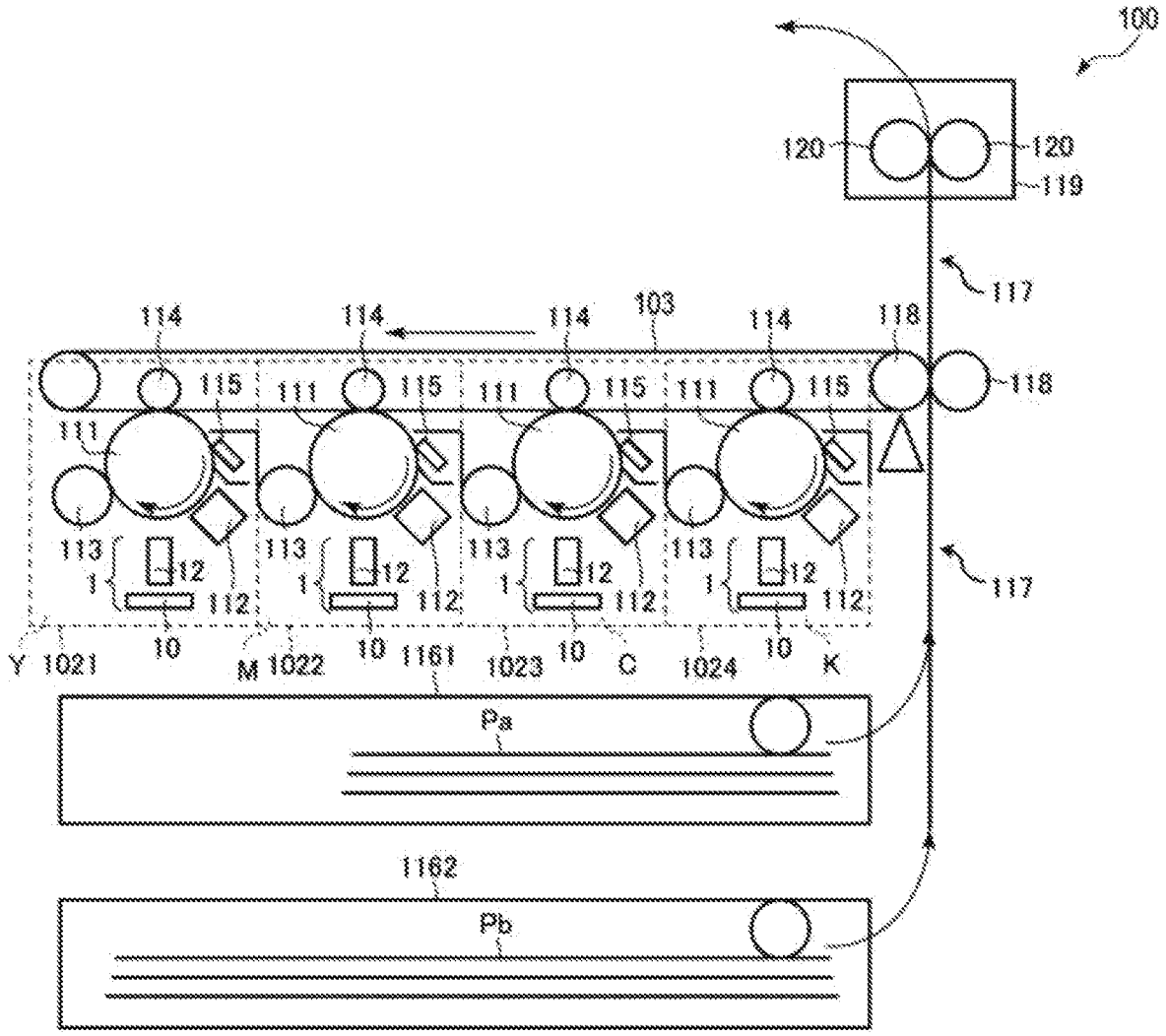
FIG. 4 is a diagram illustrating an example of the image forming apparatus.

FIG. 4 is a diagram illustrating one example of an image forming apparatus 100. FIG. 4 illustrates an example of a quadruple-tandem type color image forming apparatus. The exposure head 1 is also applicable to a monochrome image forming apparatus.

As illustrated in FIG. 4, for example, the image forming apparatus 100 includes: an image forming unit 1021 that forms a yellow Y image; an image forming unit 1022 that forms a magenta M image; an image forming unit 1023 that forms a cyan C image; and an image forming unit 1024 that forms a black K image.

The respective image forming units 1021, 1022, 1023, and 1024 have the same configuration except that the colors of toners to be used are different from each other. That is, in the vicinity of the photosensitive drum 111 of each of the image forming units 1021, 1022, 1023, and 1024, an electrostatic charger 112 as a charging unit, the exposure head 1, a developing unit 113, a transfer roller 114, and a cleaner 115 are arranged in order.

The electrostatic charger 112 uniformly charges a surface of the photosensitive drum 111. The exposure head 1 exposes the photosensitive drum 111 to light emitted from the light emitting elements 131 to form an electrostatic latent image on the photosensitive drum 111.

The developing unit 113 attaches the toner of each of the corresponding colors to the electrostatic latent image portion of the photosensitive drum 111 to develop the electrostatic latent image. That is, the developing unit 113 of the image forming unit 1021 attaches the yellow Y toner to the electrostatic latent image portion of the photosensitive drum 111 to develop the electrostatic latent image. The developing unit 113 of the image forming unit 1022 attaches the magenta M toner to the electrostatic latent image portion of the photosensitive drum 111 to develop the electrostatic latent image. The developing unit 113 of the image forming unit 1023 attaches the cyan C toner to the electrostatic latent image portion of the photosensitive drum 111 to develop the electrostatic latent image. The developing unit 113 of the image forming unit 1024 attaches the black K toner to the electrostatic latent image portion of the photosensitive drum 111 to develop the electrostatic latent image.

The transfer roller 114 transfers the developed toner image on the photosensitive drum 111 to the transfer belt 103. That is, the transfer roller 114 of the image forming unit 1021 transfers the yellow (Y) toner image developed on the photosensitive drum 111 to the transfer belt 103. The transfer roller 114 of the image forming unit 1022 transfers the developed magenta (M) toner image on the photosensitive drum 111 to the transfer belt 103. The transfer roller 114 of the image forming unit 1023 transfers the developed cyan (C) toner image on the photosensitive drum 111 to the transfer belt 103. The transfer roller 114 of the image forming unit 1024 transfers the developed black (K) toner image on the photosensitive drum 111 to the transfer belt 103. As a result, a full-color image is formed on the transfer belt 103.

The cleaner 115 cleans toner remaining on the outer circumferential surface of the photosensitive drum 111 without being transferred. Due to the cleaning, the photosensitive drum 111 enters a sleep mode for forming the next image.

The image forming apparatus 100 includes a paper cassette 1161 and a paper cassette 1162 for accommodating paper Pa and paper Pb as an image forming medium. The paper cassette 1161 accommodates the paper Pa having a small size. The paper cassette 1162 accommodates the paper Pb having a large size. The paper cassette 1161 may accommodate the paper Pb having a large size, and the paper cassette 1162 may accommodate the paper Pa having a small size. Alternatively, the paper cassette 1161 and the paper cassette 1162 may accommodate paper having the same size.

The paper Pa or the paper Pb picked up from the paper cassette 1161 or the paper cassette 1162 is transferred through a paper conveyance path 117 and passes through a transfer nip formed by a transfer roller pair 118. When the paper Pa or the paper Pb passes through the transfer nip, the toner image transferred to the outer circumferential surface of the transfer belt 91 is transferred to the paper Pa or the paper Pb. The paper Pa or the paper Pb to which the toner image is transferred is heated and pressed by a fixing roller 120 of a fixing unit 119. The toner image is fixed to the paper Pa or the paper Pb when heated and pressed by the fixing roller 120. In the image forming apparatus 100, by repeating the above-described process operations, the image forming operation is continuously performed on the paper Pa or the paper Pb.

Figure 5:
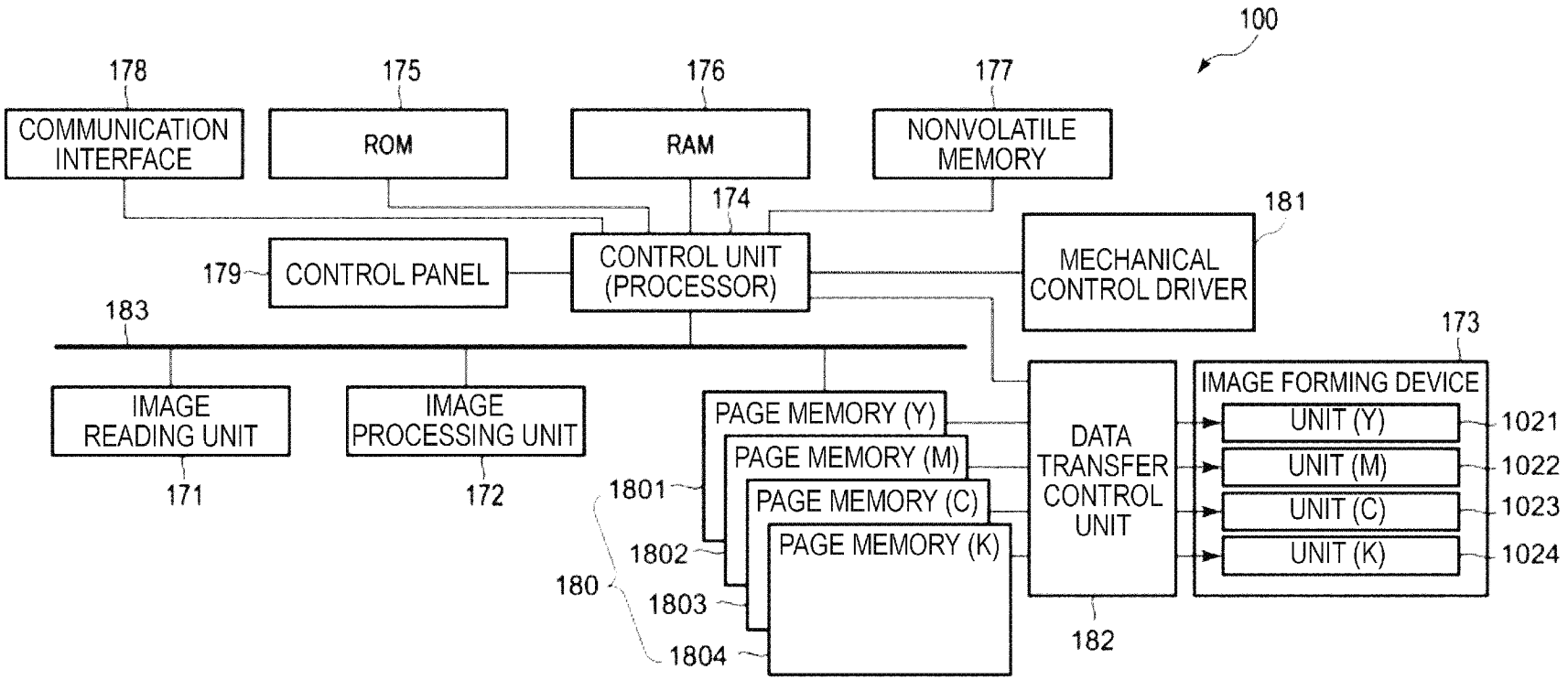
FIG. 5 is a block diagram illustrating an example of a control system in the image forming apparatus.

FIG. 5 is a block diagram illustrating an example of a control system in the image forming apparatus 100. As illustrated in FIG. 5, the image forming apparatus 100 includes an image reading unit 171, an image processing unit 172, an image forming device 173, a control unit 174, a read only memory (ROM) 175, a random-access memory (RAM) 176, a nonvolatile memory 177, a communication interface 178, a control panel 179, a page memory 180, a mechanical control driver 181, and a data transfer control unit 182.

In the image forming apparatus 100, the ROM 175, the RAM 176, the nonvolatile memory 177, the communication interface 178, the control panel 179, the mechanical control driver 181, and the data transfer control unit 182 are connected to the control unit 174. In the image forming apparatus 100, the image reading unit 171, the image processing unit 172, and the page memory 180 are connected to the control unit 174 via the image data bus 183. The page memory 180 includes a page memory 1801 for storing image data of yellow Y, a page memory 1802 for storing image data of magenta M, a page memory 1803 for storing image data of cyan C, and a page memory 1804 for storing image data of black K.

The image reading unit 171 optically reads an image of an original document to acquire image data. The image data acquired by the image reading unit 171 are output to the image processing unit 172.

The image processing unit 172 executes various image processing on the image data acquired from the image reading unit 171 or image data input via the communication interface 178. Through the image processing, the image processing unit 172 generates image data of yellow Y, image data of magenta M, image data of cyan C, and image data of black K.

The image data generated by the image processing unit 172 are stored in the page memory 180. That is, the piece of image data of yellow Y is stored in the page memory 1801. The piece of image data of magenta M is stored in the page memory 1802. The piece of image data of cyan C is stored in the page memory 1803. The piece of image data of black K is stored in the page memory 1804.

The page memories 1801, 1802, 1803, and 1804 corresponding to the respective colors are connected to the data transfer control unit 182. The image forming device 173 is connected to the data transfer control unit 182. The image forming device 173 includes image forming units 1021, 1022, 1023, and 1024 that are configured depending on the colors including yellow Y, magenta M, cyan C, and black K.

The data transfer control unit 182 controls data transfer from the page memory 180 to the image forming device 173. The data transfer control unit 182 includes, for example, a line memory and controls data transfer such that the image data are transferred one line by one line. That is, the data transfer control unit 182 transfers the image data stored in the page memory 1801 to the image forming unit 1021 one line by one line. Likewise, the data transfer control unit 182 transfers the image data stored in the page memories 1802, 1803, and 1804 to the image forming units 1022, 1023, and 1024 one line by one line.

The image forming device 173 forms an image based on the image data stored in the page memory 180. That is, the image forming device 1731 forms an image using the image forming unit 1021 based on the image data of yellow Y stored in the page memory 1801. The image forming device 1732 forms an image using the image forming unit 1022 based on the image data of magenta M stored in the page memory 1802. The image forming device 1733 forms an image using the image forming unit 1023 based on the image data of cyan C stored in the page memory 1803. The image forming device 1734 forms an image using the image forming unit 1024 based on the image data of black K stored in the page memory 1804.

The control unit 174 controls the various units that implement the functions as the image forming apparatus 100 according to various programs. For example, the control unit 174 controls an image reading operation in the image reading unit 171. The control unit 174 controls an image processing operation in the image processing unit 172. The control unit 174 controls an image forming operation in the image reading device 173. The control unit 174 is configured with one or more processors. The processor is, for example, a central processing unit (CPU).

The ROM 175 stores various programs and the like required for the control of the control unit 174. The RAM 176 temporarily stores data required for the control of the control unit 174. The nonvolatile memory 177 stores an updated program and various parameters and the like. The nonvolatile memory 177 may store some or all of various programs.

The communication interface 178 is an interface for communication with another apparatus. The communication interface 178 is used for communication with, for example, a higher-level apparatus. The higher-level apparatus will also be referred to as "external apparatus". The communication interface 178 is configured with, for example, a LAN connector. The communication interface 178 may execute wireless communication with another apparatus according to a standard such as Bluetooth (registered trademark).

The control panel 179 receives an operation input from a user or a service person. The control panel 179 includes a touch panel and a keyboard as input devices. The touch panel also functions as a display device. As information that is notified to the user, the touch panel displays, for example, an image for setting various functions of the image forming apparatus 100 or an image representing the remaining amount of toner.

The mechanical control driver 181 controls operations of motors and the like required for printing according to an instruction of the control unit 174. The mechanical control driver 181 selects the paper cassette 1161 or the paper cassette 1162 that accommodates paper such as an image forming medium according to an instruction of the control unit 174. As a result, due to the action of the image forming device 173, an image is formed on the paper Pa or the paper Pb accommodated in the selected paper cassette 1161 or the paper cassette 1162 based on the image data stored in the page memory 180.

Next, the details of the exposure head 1 will be described.

As described above, the exposure head 1 is attached to face the photosensitive drum 111 through a head attachment portion (not illustrated). Here, in principle, as indicated by a solid line 21 in FIG. 6, the light emitting element array 13 is attached parallel to the main scanning direction MD that is the longitudinal direction of the photosensitive drum 111. However, actually, as indicated by a broken line 22 in FIG. 6, the light emitting element array 13 may be attached to be inclined upward with respect to the main scanning direction MD due to the accuracy or the like of the head attachment portion. As indicated by a broken line 23 in FIG. 6, the light emitting element array 13 may be attached to be inclined downward with respect to the main scanning direction MD. The embodiment provides the exposure head 1 in which the inclination of the arrangement direction of the light emitting element array 13 with respect to the main scanning direction MD is corrected without using correction data.

Figure 7:
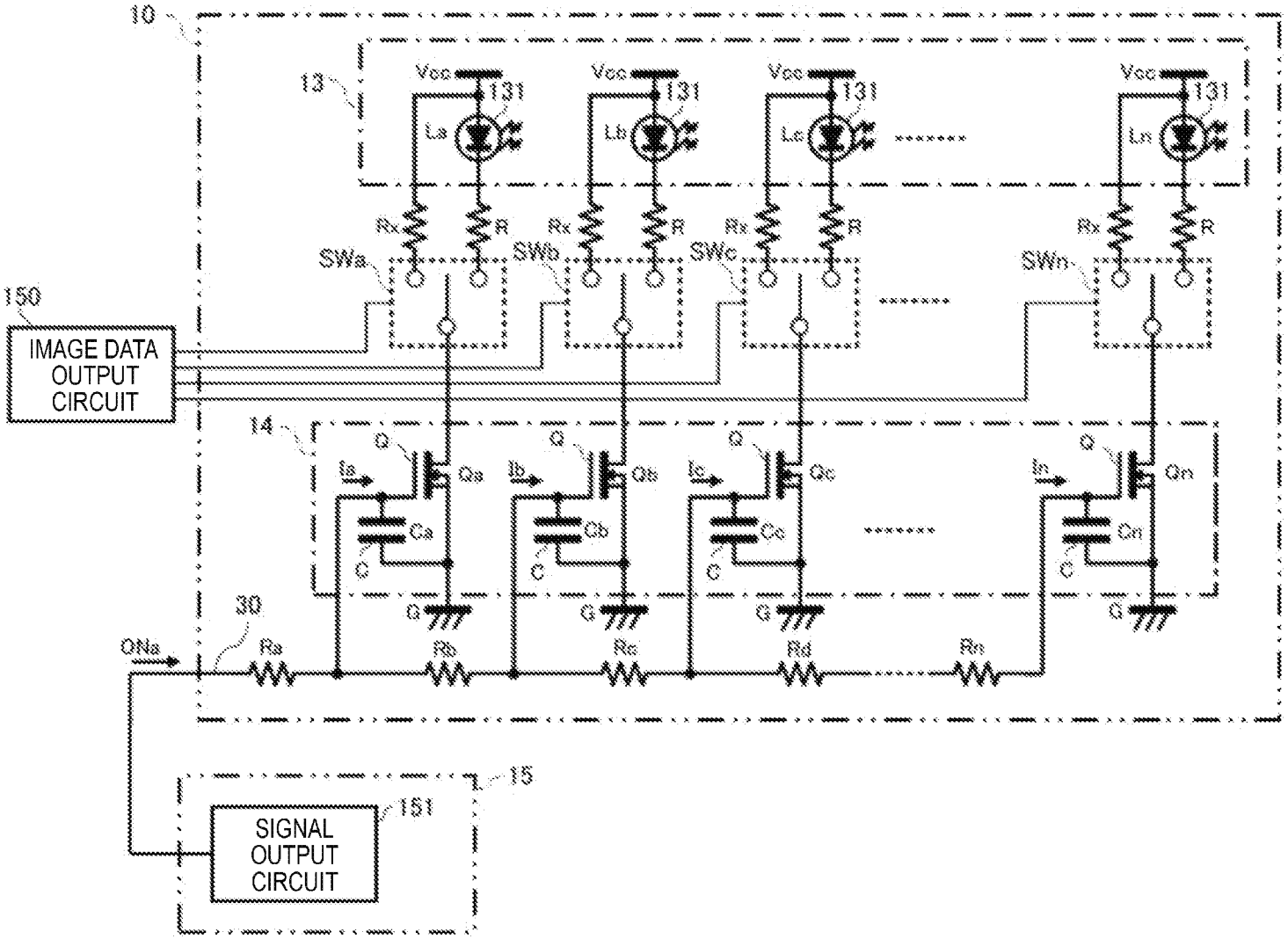
FIG. 7 is a diagram illustrating a major circuit configuration of an exposure head according to a first embodiment.

FIG. 7 is a diagram illustrating a major circuit configuration of the exposure head 1 according to a first embodiment. FIG. 7 illustrates a circuit configuration of the light emitting unit 10 and a major circuit block of the IC chip 15. The exposure head 1 includes the first light emitting element array 1311 and the second light emitting element array 1312, and the circuit configuration is common to both the light emitting element arrays 1311 and 1312. Therefore, FIG. 7 illustrates one light emitting element array 13 and the drive circuit array 14 corresponding to the light emitting element array 13 as the circuit configuration of the light emitting unit 10.

As illustrated in FIG. 7, the light emitting element array 13 includes a plurality of light emitting elements 131. The light emitting element 131 is, for example, an OLED. The light emitting element 131 may be, for example, an LED. Hereinafter, for convenience of description, the respective light emitting elements 131 that are arranged in order from a first end side to a second end side of the light emitting element array 13 will be referred to as a light emitting element La, a light emitting element Lb, a light emitting element Lc, . . . , and a light emitting element Ln.

The light emitting unit 10 include switching switches SW corresponding to the respective light emitting elements La to Ln. Hereinafter, the switching switches SW corresponding to the respective light emitting elements La to Ln will be referred to as a switching switch SWa, a switching switch SWb, a switching switch SWc, . . . , and a switching switch SWn.

Input terminals of all the respective light emitting elements La to Ln are connected to driving power terminals Vcc, and output terminals thereof are connected to ground terminals G through resistors R and the switching switches SWa to SWn. Connection points between the respective light emitting elements La to Ln and the driving power terminals Vcc are connected to the ground terminals G through resistors Rx and the switching switches SWa to SWn.

The drive circuit array 14 includes switching elements Q and capacitive elements C corresponding to the respective light emitting elements La to Ln.

The switching element Q is, for example, a MOS field effect transistor. The switching element Q may be, for example, a semiconductor element such as another transistor or a thyristor. Hereinafter, the switching elements Q corresponding to the respective light emitting elements La to Ln will be referred to as a switching element Qa, a switching element Qb, a switching element Qc, . . . , and a switching element Qn.

Drain elements of the switching elements Qa to Qn are connected to a common terminal of the switching switches SWa to SWn, and source terminals thereof are connected to the ground terminals G. Gate terminals of the switching elements Qa to Qn are connected to a transmission line 30. Due to the connection, the switching elements Q are arranged between the output terminals of the respective light emitting elements La to Ln and the ground terminals G.

Each of the switching switches SWa to SWn selectively switches between a first state where the drain element of the switching element Q connected to the common terminal is connected to the light emitting element 131 through the resistor R and a second state where the same drain element is connected to the connection point between the light emitting element 131 and the driving power terminal Vcc through the resistor Rx. Each of the switching switches SWa to SWn switches between the first state and the second state based on image data supplied from an image data output circuit 150.

The image data output circuit 150 outputs image data corresponding to one line that is received from the data transfer control unit 182. Examples of the image data include image data corresponding to a print dot and image data corresponding to a non-print dot. When the image data corresponding to a print dot is supplied, each of the switching switches SW is in the first state. When the image data corresponding to a non-print dot is supplied, each of the switching switches SW is in the second state.

The capacitive element C is, for example, a capacitor. The capacitive elements C are provided respectively corresponding to the switching elements Qa to Qn. Hereinafter, the capacitive elements C respectively corresponding to the switching elements Qa to Qn will be referred to as a capacitive element Ca, a capacitive element Cb, a capacitive element Cc, . . . , and a capacitive element Cn. The respective capacitive elements Ca to Cn are connected between the gate terminals and the source terminals of the switching elements Qa to Qn corresponding thereto. The capacitances c of the respective capacitive elements Ca to Cn are the same.

A first end portion of the transmission line 30 is connected to a signal output circuit 151 in the IC chip 15, and a second end portion thereof is connected to the gate terminal of the switching element Qn corresponding to the light emitting element Ln on the second end side. In FIG. 7, a resistor Ra, a resistor Rb, a resistor Rc, a resistor Rd, and a resistor Rn on the transmission line 30 are load resistors in the transmission line 30, that is so-called, line resistors. The transmission line 30 is designed such that resistance values r of the line resistors Ra to Rn are the same.

The signal output circuit 151 is a circuit that outputs a drive signal ONa for turning on each of the light emitting elements La to Ln. Under the control of the control unit 174, the signal output circuit 151 appropriately outputs the drive signal ONa representing the ON state.

In the exposure head 1 including the light emitting unit 10 having the above-described circuit configuration, when image data corresponding to one line are output from the image data output circuit 150, each of the switches Sa to Sn enters the first state or the second state. Here, the drive signal ONa is output from the signal output circuit 151. When the drive signal ONa representing the ON state is output from the signal output circuit 151, the capacitive element C connected to the gate terminal of each of the switching elements Q is charged with charge. When any one of the capacitive elements C enters a steady state after a predetermined charging time, the switching element Q including the gate terminal connected to the capacitive element C is turned on.

When the switching element Q is turned on, a lighting current flows between the driving power terminal Vcc and the ground terminal G. Due to the lighting current, the light emitting elements La to Ln of the light emitting element array 13 corresponding to the switches Sa to Sn in the first state are turned on. That is, the outer circumferential surface of the photosensitive drum 111 that is uniformly charged is exposed to light of the respective light emitting elements La to Ln through the rod lens array 12. Here, the timings of the respective light emitting elements La to Ln depend on timings at which the switching elements Qa to Qn corresponding thereto are turned on.

Figure 8:
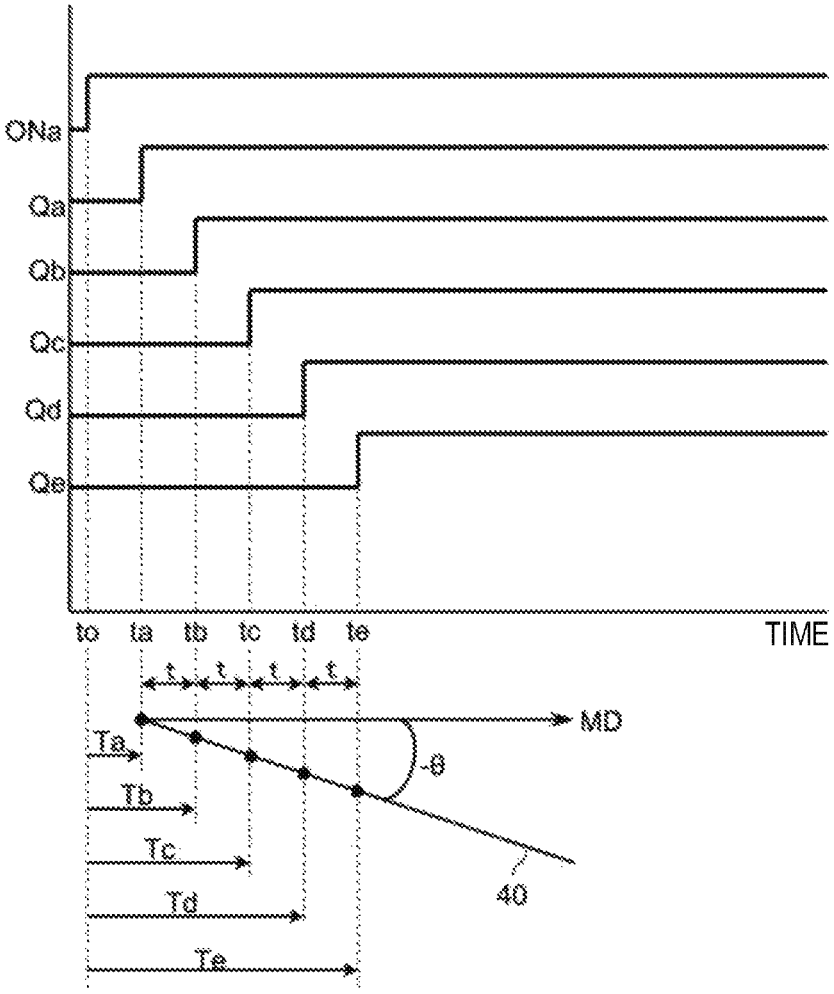
FIG. 8 is a diagram illustrating a drive signal illustrated in FIG. 7 and an ON/OFF timing of each of switching elements.

FIG. 8 illustrates a timing at which each of the switching elements Qa to Qe is turned when the drive signal ONa representing the ON state is output at time to. As illustrated in the drawing, the switching element Qa corresponding to the light emitting element La on the drive signal input end side of the transmission line 30 is turned on at time ta. A delay time Ta from time to to time ta depends on a time constant τa of the resistance value r of the line resistor Ra and the capacitance c of the capacitive element Ca. The time constant τa is a product rc of the resistance value r and the capacitance c.

The switching element Qb corresponding to the light emitting element Lb adjacent to the light emitting element La in the main scanning direction MD is turned on time tb. A delay time Tb from time to to time tb depends on a time constant τb of the respective resistance values r of the line resistors Ra and Rb and the capacitance c of the capacitive element Cb. The time constant τb is a product 2*rc* of the resistance value 2*r* and the capacitance c.

The switching element Qc corresponding to the light emitting element Lc adjacent to the light emitting element Lb in the main scanning direction MD is turned on time tc. A delay time Tc from time to to time tc depends on a time constant τc of the respective resistance values r of the line resistors Rb and Rc and the capacitance c of the capacitive element Cc. The time constant τc is a product arc of the resistance value 3*r* and the capacitance c.

Likewise, a delay time Td to a timing at which the switching element Qd corresponding to the light emitting element Ld is turned on depends on a time constant τd. The time constant τd is a product 4*rc* of the resistance value 4*r* and the capacitance c. A delay time Te to a timing at which the switching element Qe corresponding to the light emitting element Le is turned on depends on a time constant τe. The time constant τe is a product 5*rc* of the resistance value 5*r* and the capacitance c. Although not illustrated in the drawing, the times Tf to Tn to the respective switching elements Qf to Qn corresponding to the respective light emitting elements Lf to Ln after the light emitting element Le are turned on depend on time constants τf to τn.

As such, the respective capacitive elements Ca to Cn configure delay circuits together with the line resistors Ra to Rn. Here, the capacitances c of the respective capacitive elements Ca to Cn are the same. The resistance values r of the respective line resistors Ra to Rn are also the same. Accordingly, the respective switching elements Qa to Qn are turned on in order from the switching element Qa on the drive signal input end side to the switching element Qn on the second end side while being delayed by a given time t. As a result, the respective light emitting elements La to Ln are turned on in order from the light emitting element La on the drive signal input end side to the light emitting element Ln on the second end side while being delayed by a given time t. During the delay, the photosensitive drum 111 rotates in the sub-scanning direction SD. When the scanning speed in the sub-scanning direction SD is represented by "v", the outer circumferential surface of the photosensitive drum 111 is exposed in order from the first end side to the second end side in the main scanning direction MD while being displaced in the sub-scanning direction SD by a distance "vt". As a result, as illustrated in FIG. 8, a line image 40 that is inclined downward by an angle −θ with respect to the main scanning direction MD is formed on the outer circumferential surface of the photosensitive drum 111.

Incidentally, when an OLED is used as the light emitting element 131, the linearity in the main scanning direction MD is secured. Accordingly, the line image 40 has a high quality without being stepwise even in an enlarged view.

Therefore, by using the exposure head 1 according to the first embodiment in the image forming apparatus 100, a high-quality line image 40 that is inclined downward by an angle −θ with respect to the main scanning direction MD can be formed on the outer circumferential surface of the photosensitive drum 111. Therefore, when the exposure head 1 is attached in a state where it is inclined upward by the angle θ with respect to the main scanning direction MD due to the accuracy of the head attachment portion, the exposure head 1 according to the embodiment is adopted. As a result, the line image 40 that is inclined in a direction opposite to the inclination of the exposure head 1 is formed. Therefore, an image that is parallel to the photosensitive drum 111 in the main scanning direction MD can be formed.

Accordingly, data processing in the related art of storing information regarding the inclination with respect to the main scanning direction in a memory as correction data and correcting image data such that the inclination of an exposure head is canceled out with the correction data can be made unnecessary. As a result, calculation for the correction is unnecessary, and thus the processing load of a processor can be reduced. Memory resources can also be saved.

The image forming apparatus 100 includes a plurality of image forming units, for example, the image forming unit 1021, the image forming unit 1022, the image forming unit 1023, and the image forming unit 1024. Unless the image forming units 1021, 1022, 1023, and 1024 are parallel to the main scanning direction MD, the angles of the respective toner images on the transfer belt 103 are relatively shifted from each other. Therefore, in order make the main scanning directions MD of the respective image forming units 1021, 1022, 1023, and 1024 to be parallel to each other, an image that is not parallel to the main scanning direction MD may be intentionally formed on the photosensitive drum 111.

The transmission line 30 is configured to supply the drive signal ONa in order from the switching element Qa corresponding to the light emitting element La on the first end side of the light emitting element array 13 to the switching element Qn corresponding to the light emitting element Ln on the second end side of the light emitting element array 13. Specifically, the transmission line 30 includes a first end portion and a second end portion. The transmission line 30 is configured to supply the drive signal ONa input from the first end portion in order from the switching element Qa corresponding to the light emitting element La on the first end side to the switching element Qn corresponding to the light emitting element Ln on the second end side.

Here, the resistance values r of the line resistors Ra to Rn are the same. Therefore, the capacitances of the respective capacitive elements Ca to Cn connected to the respective switching elements Qa to Qn may be the same. By adopting the respective capacitive elements Ca to Cn having an appropriate capacitance, the exposure head 1 for forming the line image 40 that is inclined in a direction opposite to the inclination of the exposure head 1 can be easily prepared.

The IC chip 15 is arranged on the transparent substrate 11 on which the light emitting element array 13 is formed. The drive signal ONa is applied to the first end portion of the transmission line 30 from the signal output circuit 151 into which the IC chip 15 is incorporated. Accordingly, due to the light emitting unit 10 and the rod lens array 12 in the transparent substrate 11, the exposure head 1 that can form an image parallel to the photosensitive drum 111 in the main scanning direction MD can be provided. As a result, for example, effects of simplifying and minimizing the exposure head 1 can be exhibited.

Figure 9:
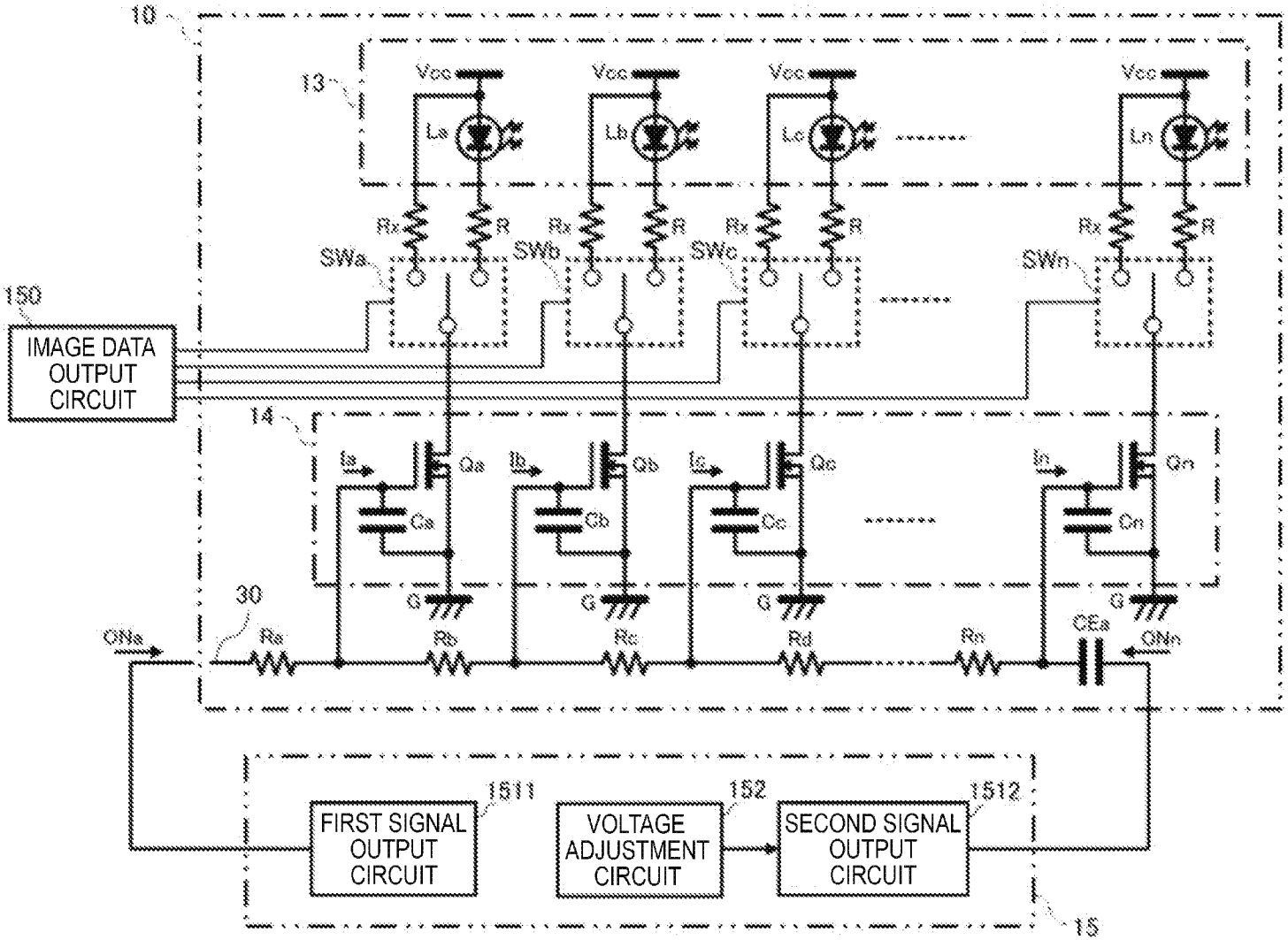
FIG. 9 is a diagram illustrating a major circuit configuration of an exposure head according to a second embodiment.

FIG. 9 is a diagram illustrating a major circuit configuration of the exposure head 1 according to a second embodiment. As in FIG. 7, FIG. 9 illustrates a circuit configuration of the light emitting unit 10 and a major circuit block of the IC chip 15. FIG. 9 illustrates one light emitting element array 13 and the drive circuit array 14 corresponding to the light emitting element array 13 as the circuit configuration of the light emitting unit 10.

A difference between the exposure head 1 according to the second embodiment and the exposure head 1 according to the first embodiment is the configuration of the second end side of the transmission line 30. Another difference is a part of the circuit in the IC chip 15. The other configurations are the same as those of the first embodiment. Therefore, components common to those of the first embodiment will be represented by the same reference numerals, and the detailed description thereof will not be repeated.

The transmission line 30 includes a first end portion and a second end portion. The transmission line 30 supplies supply the drive signal ONa input from the first end portion in order from the switching element Qa corresponding to the light emitting element La on the first end side to the switching element Qn corresponding to the light emitting element Ln on the second end side.

In the second embodiment, a capacitive element CEa is connected to the second end portion of the transmission line 30. A first end of the capacitive element CEa is connected to the second end portion of the transmission line 30, and a second end of the capacitive element CEa is connected to a second signal output circuit 1512 described below.

The IC chip 15 includes a first signal output circuit 1511, a second signal output circuit 1512, and a voltage adjustment circuit 152. The first signal output circuit 1511 has the same function as that of the signal output circuit 151 according to the first embodiment. That is, the first signal output circuit 1511 outputs the drive signal ONa for turning on each of the light emitting elements La to Ln. Hereinafter, this drive signal ONa will be referred to as "first drive signal ONa".

The second signal output circuit 1512 outputs a signal ONn for adjusting a turn-on start timing of each of the light emitting elements La to Ln. Hereinafter, the signal ONn will be referred to as "second drive signal".

The second drive signal ONn is a signal having a lower voltage than the first drive signal ONa. The voltage adjustment circuit 152 adjusts the voltage of the second drive signal ONn output from the second signal output circuit 1512 in a range not exceeding the voltage of the first drive signal ONa.

The first signal output circuit 1511 and the second signal output circuit 1512 outputs the first drive signal ONa and the second drive signal ONn at the same timing. As a result, the first drive signal ONa is input from the first end portion of the transmission line 30. The second drive signal ONn is input from the second end portion of the transmission line 30.

Here, the second drive signal ONn has a lower voltage than the first drive signal ONa, and thus a potential difference is generated between both ends of the capacitive element CEa. As a result, the time constant τ relating to the delay time until each of the switching elements Qa to Qn is turned on changes. When the time constant τ changes, the delay time until each of the switching elements Qa to Qn is turned on changes. When the delay time changes, for example, the angle −θ of the downward inclination in the line image 40 illustrated in FIG. 8 changes.

The delay time until each of the switching elements Qa to Qn is turned on is determined depending on the potential difference generated between both ends of the capacitive element CEa. That is, the delay time is adjusted according to the voltage of the second drive signal ONn adjusted by the voltage adjustment circuit 152. Therefore, the voltage adjustment circuit 152 functions as the delay adjustment circuit together with the second signal output circuit 1512 and the capacitive element CEa.

By adjusting the delay time until each of the switching elements Qa to Qn is turned on, the angle −θ of the downward inclination in the line image 40 can be adjusted. As a result, even when the angle θ of the upward inclination with respect to the main scanning direction of the exposure head 1 varies in a range of [0<θ<90], the exposure head 1 that can form the line image 40 having an angle −θ of the downward inclination capable of canceling out the angle θ of the upward inclination can be provided.

In the exposure head 1, calculation for the correction is unnecessary, and thus the processing load of a processor can be reduced. Memory resources can also be saved.

Even in the second embodiment, not only the first signal output circuit 1511 corresponding to the signal output circuit 151 according to the first embodiment but also the second signal output circuit 1512 and the voltage adjustment circuit 152 are provided in the IC chip 15. Accordingly, as in the first embodiment, for example, effects of simplifying and minimizing the exposure head 1 can be exhibited.

Figure 10:
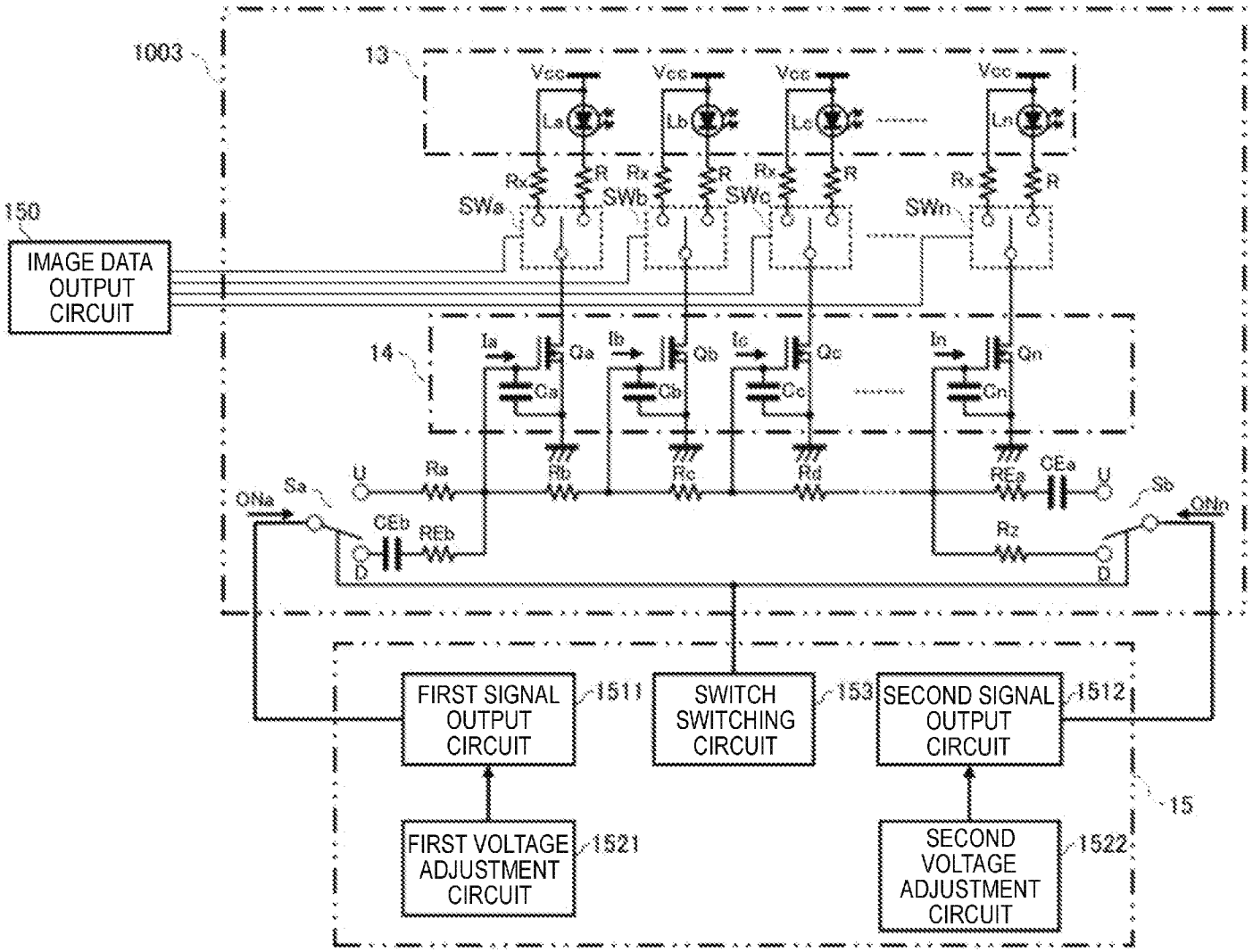
FIG. 10 is a diagram illustrating a major circuit configuration of an exposure head according to a third embodiment.

FIG. 10 is a diagram illustrating a major circuit configuration of the exposure head 1 according to a third embodiment. As in FIGS. 7 and 9, FIG. 10 illustrates a circuit configuration of the light emitting unit 10 and a major circuit block of the IC chip 15. FIG. 10 illustrates one light emitting element array 13 and the drive circuit array 14 corresponding to the light emitting element array 13 as the circuit configuration of the light emitting unit 10.

A difference between the exposure head 1 according to the third embodiment and the exposure head 1 according to the second embodiment is the configurations of the first end side and the second end side of the transmission line 30. Another difference is a part of the circuit in the IC chip 15. The other configurations are the same as those of the second embodiment. Therefore, components common to those of the second embodiment will be represented by the same reference numerals, and the detailed description thereof will not be repeated.

The transmission line 30 includes a first end portion and a second end portion. A two-terminal switch Sa and a two-terminal switch Sb each of which selectively switch between a first terminal U and a second terminal D are connected to the first end portion and the second end portion of the transmission line 30.

The first terminal U of the two-terminal switch Sa is connected to the gate terminal of the switching element Qa corresponding to the light emitting element La on the first end side. The first terminal U of the two-terminal switch Sa is connected to a first end of a capacitive element CEb. A second end of the capacitive element CEb is connected to the first end of the transmission line 30.

The first terminal U of the two-terminal switch Sb is connected to a first end of the capacitive element CEb. A second end of the capacitive element CEa is connected to the second end of the transmission line 30. The second terminal D of the two-terminal switch Sb is connected to the gate terminal of the switching element Qn corresponding to the light emitting element Ln on the second end side.

When the two-terminal switch Sa is connected to the first terminal U, the two-terminal switch Sb is also connected to the first terminal U. When the two-terminal switch Sa is connected to the second terminal D, the two-terminal switch Sb is also connected to the second terminal D. The switching of the two-terminal switch Sa and the two-terminal switch Sb is controlled by a switch switching circuit 153 provided in the IC chip 15.

When both the two-terminal switch Sa and the two-terminal switch Sb are connected to the first terminals U, the transmission line 30 supplies the first drive signal ONa output from the first signal output circuit 1511 in order from the switching element Qa corresponding to the light emitting element La on the first end side to the switching element Qn corresponding to the light emitting element Ln on the second end side. A potential difference corresponding to the voltage values of the first drive signal ONa and the second drive signal ONn is generated between both ends of the capacitive element CEa provided at the second end of the transmission line 30.

In the IC chip 15, a first voltage adjustment circuit 1521 and a second voltage adjustment circuit 1522 are further provided. The first voltage adjustment circuit 1521 adjusts the voltage of the first drive signal ONa output from the first signal output circuit 1511. The second voltage adjustment circuit 1522 adjusts the voltage of the second drive signal ONn output from the second signal output circuit 1512.

Therefore, the switch switching circuit 153 is in the state where both the two-terminal switch Sa and the two-terminal switch Sb are connected to the first terminals U. Here, the first voltage adjustment circuit 1521 adjusts the voltage of the first drive signal ONa to a voltage required to turn on each of the switching elements Q. On the other hand, the second voltage adjustment circuit 1522 adjusts the voltage of the second drive signal ONn in a range not exceeding the voltage of the first drive signal ONa. As a result, the same effects as those of the second embodiment can be exhibited. That is, even when the angle θ of the upward inclination with respect to the main scanning direction of the exposure head 1 varies in a range of [0<θ<90], the exposure head 1 that can form the line image 40 having an angle −θ of the downward inclination capable of canceling out the angle θ of the upward inclination can be provided.

The switch switching circuit 153 is in the state where both the two-terminal switch Sa and the two-terminal switch Sb are connected to the second terminals U. Here, the second voltage adjustment circuit 1522 adjusts the voltage of the second drive signal ONn to a voltage required to turn on each of the switching elements Q. On the other hand, the first voltage adjustment circuit 1521 adjusts the voltage of the first drive signal ONa in a range not exceeding the voltage of the second drive signal ONn. As a result, the following effects can be exhibited. That is, even when the angle −θ of the downward inclination with respect to the main scanning direction of the exposure head 1 varies in a range of [0<−θ<−90], the exposure head 1 that can form the line image 40 having an angle θ of the upward inclination capable of canceling out the angle −θ of the downward inclination can be provided.

Figure 6:
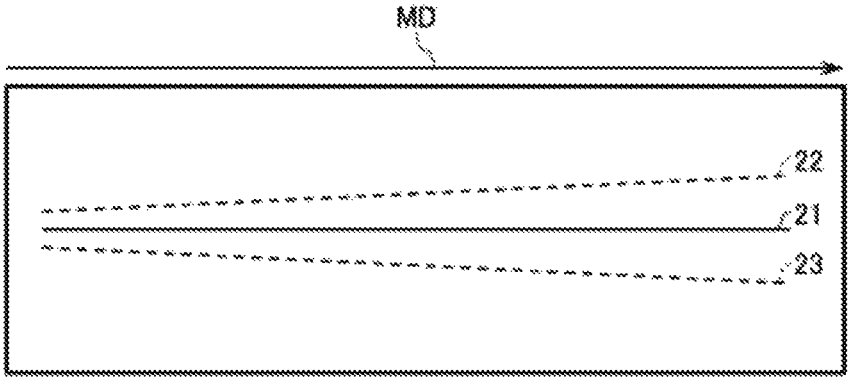
FIG. 6 is a diagram illustrating an example of an arrangement direction of the light emitting element array with respect to the main scanning direction.

Therefore, according to the third embodiment, not only when the light emitting element array 13 is inclined upward with respect to the main scanning direction MD as indicated by a broken line 22 in FIG. 6 but also when the light emitting element array 13 may be attached to be inclined downward with respect to the main scanning direction MD as indicated by the broken line 23 in FIG. 6, the exposure head 1 in which the inclination of the arrangement direction of the light emitting element array 13 with respect to the main scanning direction is corrected without using correction data can be provided.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An exposure head, comprising:

a light emitting device in which a plurality of light emitting elements are arranged in a first direction;

a plurality of switching elements configured to perform switching such that, when a drive signal is input, a drive current flows through a light emitting element corresponding to the drive signal, the switching elements being provided respectively corresponding to the light emitting elements;

a transmission line configured to supply a drive signal to the switching elements; and a plurality of delay circuits configured to delay the drive signal that is supplied to the switching elements through the transmission line in order from a first end side to a second end side of the light emitting elements arranged in the first direction, the delay circuits provided respectively corresponding to the switching elements, and a delay adjustment circuit configured to adjust periods of time by which the drive signal is delayed by the delay circuits, wherein the transmission line includes a first end portion and a second end portion and supplies the drive signal input from the first end portion in order from the switching element corresponding to the light emitting element on the first end side to the switching element corresponding to the light emitting element on the second end side, and the delay adjustment circuit includes a capacitive element that is connected to the second end portion of the transmission line.

2. The exposure head according to claim 1, wherein the transmission line supplies the drive signal in order from a switching element corresponding to the light emitting element on the first end side among the light emitting elements to a switching element corresponding to the light emitting element on the second end side among the light emitting elements.

3. The exposure head according to claim 1, further comprising a signal output circuit configured to apply the drive signal to the first end portion of the transmission line.

4. The exposure head according to claim 1, further comprising:

a first signal output circuit configured to apply the drive signal as a first signal to the first end portion of the transmission line;

a second signal output circuit configured to apply a second signal having a lower voltage than the first signal to the second end portion of the transmission line; and a voltage adjustment circuit configured to adjust the voltage of the second signal.

5. The exposure head according to claim 1, wherein the capacitive element is a first capacitive element, and wherein the transmission line supplies the drive signal input from the second end portion in order from the switching element corresponding to the light emitting element on the second end side to the switching element corresponding to the light emitting element on the first end side, the delay adjustment circuit comprises a second capacitive element connected to the second end portion of the transmission line, and the exposure head further comprises:

a switching component configured to switch between a first transmission line state where the drive signal input from the first end portion flows to the first capacitive element and a second transmission line state where the drive signal input from the second end portion flows to the second capacitive element; and a signal output circuit configured to apply the drive signal as a first signal to the first end portion of the transmission line when the transmission line is in the first transmission line state and configured to apply a second signal having a lower voltage than the first signal to the second end portion of the transmission line when the transmission line is in the second transmission line state.

6. The exposure head according to claim 5, further comprising a voltage adjustment circuit configured to adjust the voltage of the second signal.

7. An image forming apparatus, comprising:

a photosensitive drum; and an exposure head comprising a light emitting device in which a plurality of light emitting elements are arranged in a first direction along a longitudinal direction of the photosensitive drum, a plurality of switching elements configured to perform switching such that, when a drive signal is input, a drive current flows through a light emitting element corresponding to the drive signal, the switching elements being provided respectively corresponding to the light emitting elements, a transmission line configured to supply a drive signal to the switching elements, a plurality of delay circuits configured to delay the drive signal that is supplied to the switching elements through the transmission line in order from a first end side to a second end side of the light emitting elements arranged in the first direction, the delay circuits provided respectively corresponding to the switching elements; and a delay adjustment circuit configured to adjust periods of time by which the drive signal is delayed by the delay circuits, wherein the transmission line includes a first end portion and a second end portion and supplies the drive signal input from the first end portion in order from the switching element corresponding to the light emitting element on the first end side to the switching element corresponding to the light emitting element on the second end side, and the delay adjustment circuit includes a capacitive element that is connected to the second end portion of the transmission line.

8. The image forming apparatus according to claim 7, wherein the transmission line supplies the drive signal in order from a switching element corresponding to the light emitting element on the first end side among the light emitting elements to a switching element corresponding to the light emitting element on the second end side among the light emitting elements.

9. The image forming apparatus according to claim 7, further comprising a signal output circuit configured to apply the drive signal to the first end portion of the transmission line.

10. The image forming apparatus according to claim 7, further comprising:

a first signal output circuit configured to apply the drive signal as a first signal to the first end portion of the transmission line;

a second signal output circuit configured to apply a second signal having a lower voltage than the first signal to the second end portion of the transmission line; and a voltage adjustment circuit configured to adjust the voltage of the second signal.

11. The image forming apparatus according to claim 7, wherein the capacitive element is a first capacitive element, and wherein the transmission line supplies the drive signal input from the second end portion in order from the switching element corresponding to the light emitting element on the second end side to the switching element corresponding to the light emitting element on the first end side, the delay adjustment circuit comprises a second capacitive element connected to the second end portion of the transmission line, and the exposure head further comprises:

a switching component configured to switch between a first transmission line state where the drive signal input from the first end portion flows to the first capacitive element and a second transmission line state where the drive signal input from the second end portion flows to the second capacitive element; and a signal output circuit configured to apply the drive signal as a first signal to the first end portion of the transmission line when the transmission line is in the first transmission line state and configured to apply a second signal having a lower voltage than the first signal to the second end portion of the transmission line when the transmission line is in the second transmission line state.

12. The image forming apparatus according to claim 11, further comprising a voltage adjustment circuit configured to adjust the voltage of the second signal.

13. An exposure method, comprising:

switching, by a plurality of switching elements arranged in a first direction, such that, when a drive signal is input, a drive current flows through a light emitting element corresponding to the drive signal, the switching elements being provided respectively corresponding to the light emitting elements;

supplying a drive signal to the switching elements by a transmission line;

delaying, by a plurality of delay circuits, the drive signal that is supplied to the switching elements through the transmission line in order from a first end side to a second end side of the light emitting elements arranged in the first direction, the delay circuits provided respectively corresponding to the switching elements; and adjusting, by a delay adjustment circuit, periods of time by which the drive signal is delayed by the delay circuits, wherein the transmission line includes a first end portion and a second end portion and supplies the drive signal input from the first end portion in order from the switching element corresponding to the light emitting element on the first end side to the switching element corresponding to the light emitting element on the second end side, and the delay adjustment circuit includes a capacitive element that is connected to the second end portion of the transmission line.

14. The exposure method according to claim 13, further comprising:

supplying the drive signal through the transmission line in order from a switching element corresponding to the light emitting element on the first end side among the light emitting elements to a switching element corresponding to the light emitting element on the second end side among the light emitting elements.

* * * * *